United States Patent [19]

Batten

[11] Patent Number: 4,721,022

[45] Date of Patent: Jan. 26, 1988

[54] WRENCHING TOOL

[75] Inventor: Ronald W. Batten, Torrance, Calif.

[73] Assignee: VSI Corporation, Pasadena, Calif.

[21] Appl. No.: 823,009

[22] Filed: Jan. 27, 1986

[51] Int. Cl.[4] ..... B25B 17/00

[52] U.S. Cl. ..... 81/56; 81/57.14; 81/57.36

[58] Field of Search ..... 81/55, 128, 56, 57.34, 81/57.36, 129, 57.16, 13, 54, 57.14, 57.3; 403/322

[56] References Cited

U.S. PATENT DOCUMENTS

| | | | |
|---|---|---|---|
| 3,282,136 | 11/1966 | Maichen | 81/129 |
| 3,397,601 | 8/1968 | Batten | 81/56 |
| 4,538,483 | 9/1985 | Batten | 81/56 |

*Primary Examiner*—Frederick R. Schmidt
*Assistant Examiner*—Bradley I. Vaught
*Attorney, Agent, or Firm*—Plante Strauss Vanderburgh

[57] ABSTRACT

There is disclosed an improved wrenching tool which utilizes readily removable key member that is axially restrained in a key holder of the tool member by a detent ball and that can be released from the tool by precisely aligning the key holder to the outer, rotationally driven socket member of the tool. This invention comprises a release mechanism to locate the key holder in the tool at the precise position where the detent ball is aligned with a ball cavity in the outer socket member, thus permitting lateral displacement of the detent ball, and releasing the central key member. Preferably the key release includes a knob on a shaft which extends through a sidewall of the tool housing and which internally supports a cam that is received in a cam guide on an axially sliding block which is secured in a subassembly to the key holder.

16 Claims, 8 Drawing Figures

WRENCHING TOOL

BACKGROUND OF THE INVENTION

1. Field of Invention

This invention relates to a power assisted wrenching tool, and, in particular, to a wrenching tool for attachment of fasteners in loose and interference fit applications.

2. Brief Statement of the Prior Art

Threaded fasteners are frequently used in loose fit applications in which it is difficult to work from both sides of the workpiece. This occurs quite frequently in the aerospace industry, and a particular fastening system has been developed in this industry. This system employs frangible fasteners comprising a bolt with a threaded nut member having a threaded collar and a distal wrenching ring separated by a notched section that provides a predetermined limiting torque which when exceeded, permits the wrenching ring to shear from the threaded collar, leaving the latter in place at a precise and predetermined tensile loading on the bolt member. Often, the threaded collar has an upset portion, usually a slightly elliptical shape, to provide a frictional spring lock to prevent the fastener from spinning off in the event that the residual tension on the fastener is lost. Typically, these fasteners are used both in loose and interference fit applications, and in the former applications it has been the practice to use a drive tool having a center key which is inserted into a broached keyway of the bolt to hold the bolt stationary while the threaded collar is applied.

Typically, the center key is mounted in a keyway broached in the center core of a key holder member of the wrenching tool. The holder member is slideably received in a central through bore of the driven, socket member. The key is locked in the core of the holder member usually by a set screw. This attachment is cumbersome and causes delays and difficulties in changing the tool between interference and loose fit applications, since in only the latter is the key necessary. Also, the key often breaks during use and it is necessary to replace broken and worn keys, again a time consuming operation with the customary set screw lock. Occasionally, the key becomes jammed in a bolt during the application of a threaded fastener and, when this occurs, the tool is immobilized and difficulties are experienced in removing the tool from the work.

In my prior, parent application, Ser. No. 514,783, now U.S. Pat. No. 4,538,483, I disclose an improved wrenching tool in which a key member is provided with a distal grove and is received in a key holder which has a detent ball that is mounted in a lateral bore and that engages the distal grove of the key member. The key holder is slidably received in a central bore of the rotationally driven socket member which has an interior ball cavity. The precise alignment of the ball cavity in the socket member with the lateral grove of the key holder permits the detent ball to move outwardly, releasing the key and permitting its removal.

The aforedescribed invention is illustrated with a tool gear train in which the key holder, and outer member are accessible from an end wall of the gear housing. Many of the drive tools, however, employ a key holder which is not accessible from an end wall of the tool. This invention provides a simple but effective modification to such drive tools which permits removal and replacement of the key members.

BRIEF STATEMENT OF THE INVENTION

This inention comprises a rotational drive assembly for sockets and coaxial key members used with frangible fasteners in which the coaxial key member is rotationally restrained and is used to rotationally immobilize the bolt of the fastener system. The invention utilizes keys having a distal grove on the end received in the tool and captured therein by a detent ball which seats in the distal grove of the key. The rotational drive tool has a rotationally driven socket member, and this member has a ball cavity which must be aligned with the lateral grove of the key holder member to permit the detent ball to move outwardly and release the key member. In this invention, the rotational drive tool is provided with a key release mechanism which includes a knob that is attached to a shaft which is rotationally mounted in a sidewall of the tool housing and which supports a cam within the housing that is received in a cam guide on an axially sliding block which is pinned to key holder subassembly of a central shaft and the key holder. Rotation of the release mechanism shaft thus moves the cam and displaces the key holder subassembly the precise axial distance required to align the ball cavity of the outer socket member with the lateral bore of the key holder, permitting the detent ball to be laterally displaced from the distal grove of the key member, and releasing the key member for removal and replacement.

BRIEF DESCRIPTION OF THE DRAWINGS

The invention will be described with reference to the Figures of which.

DESCRIPTION OF THE PREFERRED EMBODIMENT

Figure 1:
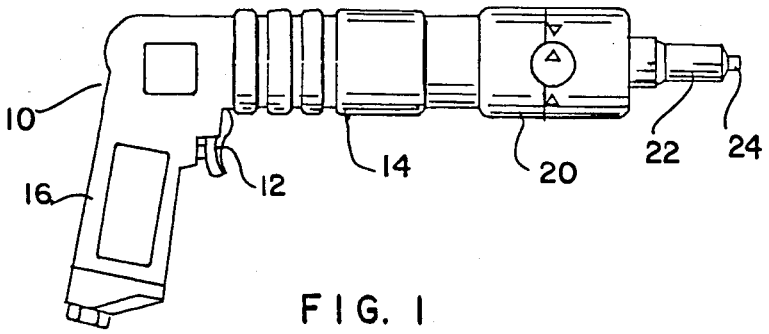
FIG. 1 is an elevational view of a typical drive tool modified in accordance with the invention.

Referring to the FIG. 1, the wrenching tool 10 comprises a conventional pistol grip 16 with a trigger control 12 and a drive motor assembly 14 which typically houses an air motor. The output shaft of the air motor is engaged in a gear train within gear housing 20. The gear train has a centrally positioned output shaft which removably receives socket member 22 and a rotationally immobilized, and axially sliding key holder 24, which removably receives a key member, not shown.

Figure 2:
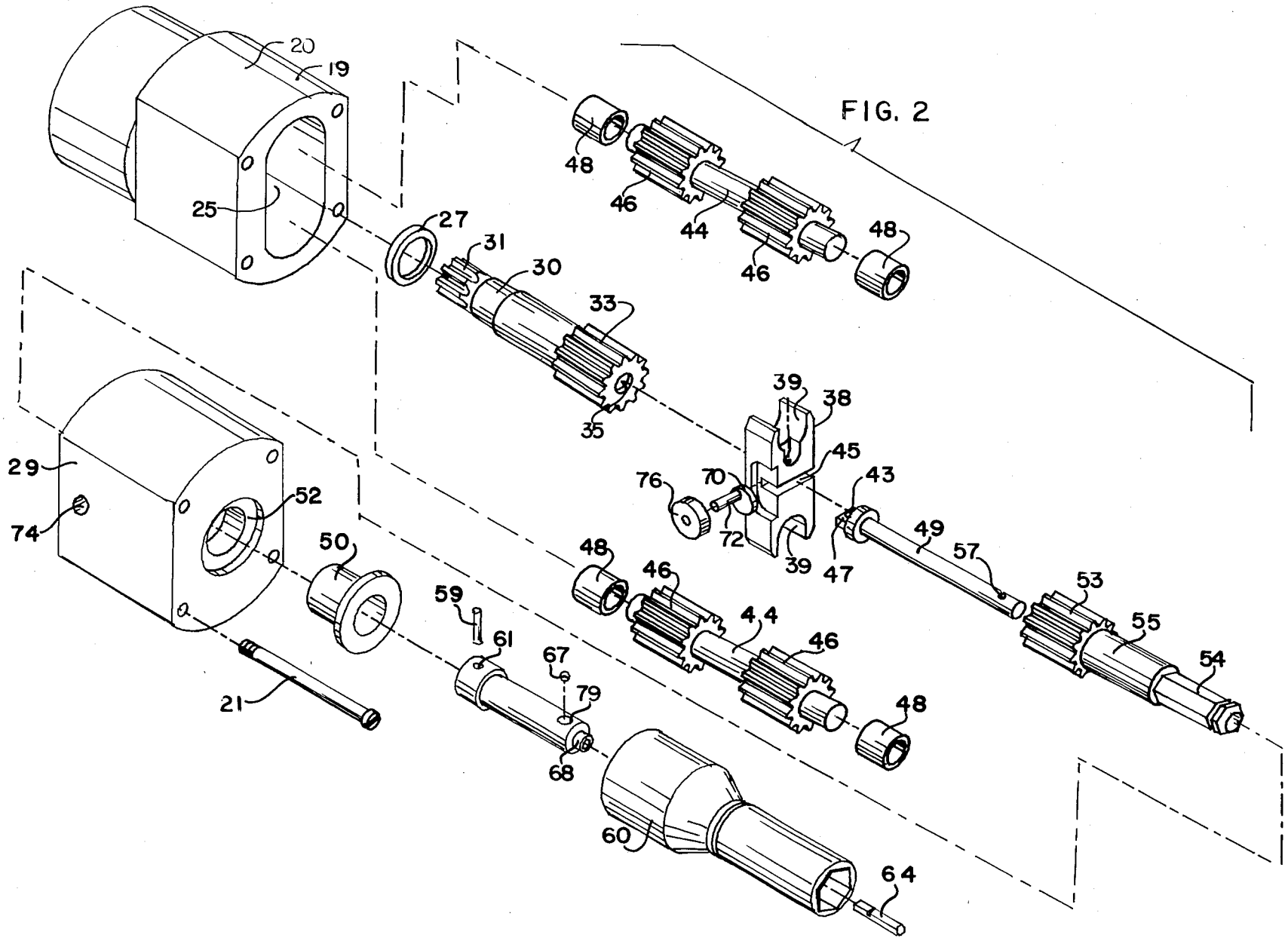
FIG. 2 is an exploded perspective view of the gear train and socket and key members of the invention.

Referring now to FIG. 2, the gear train is received in gear housing 20 which is formed of opposite housing ends 19 and 29 which are secured thereto by retaining screws such as 21. The housing 20 has a generally rectangular internal cavity 25. The input drive shaft 30 for the gear train assembly has a splined end 31 which is received by the power output shaft (not shown) of the air motor assembly 14. Shaft 30 is rotationally received in a central bore (not shown) in the inside end wall of the gear housing end 19 and is provided with a suitable bearing 27. The opposite end of the input shaft 30 has a wide-faced spur gear 33 having a central bore 35 which receives a compression spring 36. A slide block 38 which has a shape closely conforming to the housing cavity 25 of the housing 20 and distal arcuate notches 39 is slidably mounted in housing cavity 25. Each notch 39 provides clearance for a shaft 44 which distally carries a pair of wide-faced spur gears 46, identical to gear 33. The shafts 44 are mounted in needle bearings 48, which are received in bores (not shown) in the inside wall of housing end 19 and the inside wall housing end 29. The forward face of slide block 38 has a cross slot 45 and this cross slot receives the flatted end 47 of the key shaft 49. The key shaft receives power output sleeve 55 which has a wide-faced spur gear 53 at one end and a flatted hexagonal opposite end 54.

The resulting assembly of the previously described parts provides a gear train assembly in which the power output sleeve 55 is rotationally driven through the assembly of spur gears 33, 46 and 53, and the key shaft is rotationally restrained by slide block 38. The slide block 38 is slidably mounted in this assembly and in the cavity 25 of the housing 20 such that it and shaft 49 can be axially displaced, against the resilient bias of spring 36, during rotational driving of power output shaft 55.

The remainder of the assembly includes an end support bearing 50 which is received in a central aperture 52 of housing end 29, and the socket member 60 that is removably received over the end of power output shaft 55.

Figure 3:
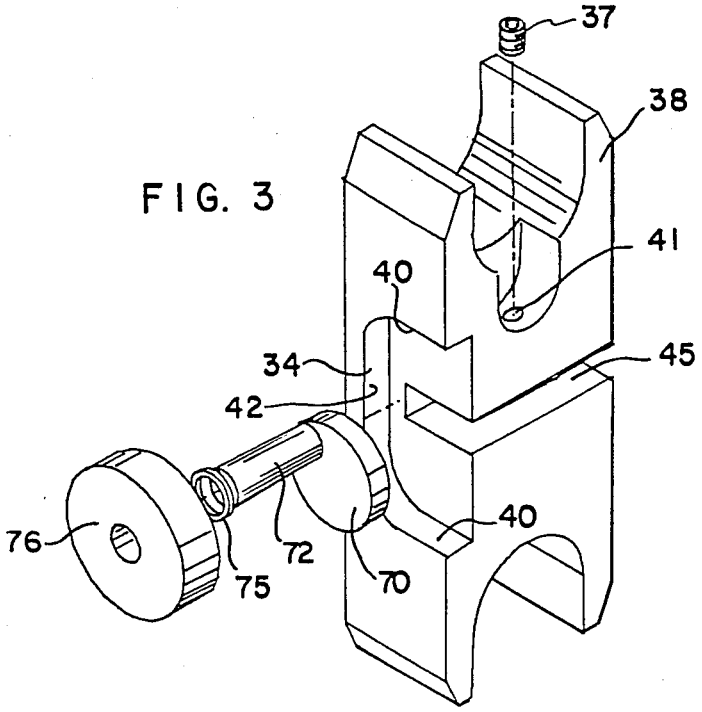
FIG. 3 is an enlarged view of the release mechanism shown in FIG. 2.

While the aforedescribed construction is conventional, the following modifications are made in accordance with this invention, and are shown in greater detail in FIG. 3. The central key shaft 49 is fixedly secured to slide block 38 by pin 37 that is seated in a through bore 41 which is bored in the slide block 28 and an aligned bore 43 in the end of the central key shaft 49. A cam guide 34 is also milled into one side of slide block 38. This can guide 34 has a vertical sidewall 42 and arcuate upper and lower walls 40. A cam 70 is mounted within the housing 28 on integral cam shaft 72 which is received in aperture 74 bored into the sidewall of housing end 29 (see FIG. 2) and positioned to locate the cam 70 in the cam guide 34. On its outer end, cam shaft 72 supports a knob 76, and an O-ring 75 is provided on shaft 72 to frictionally engage between knob 76 and the housing wall, thereby restraining the cam assembly and preventing unintentional release of the key member 64.

The key member 64 is received in a key holder 66 which has a central bore 68 that is broached with standard hexagonal flats to index with the hexagonal shank of key 64. The key holder 66 has a shank 63 which is received within socket member 60 and has a distal lateral bore 79 in which is seated a detent ball 67. The opposite end of key holder 66 has a larger diameter end and a through lateral bore 61 which receives pin 59 that engages in aperture 57 of key shaft 49. The assembly of these latter elements is shown in detail in FIG. 4.

Figure 4:
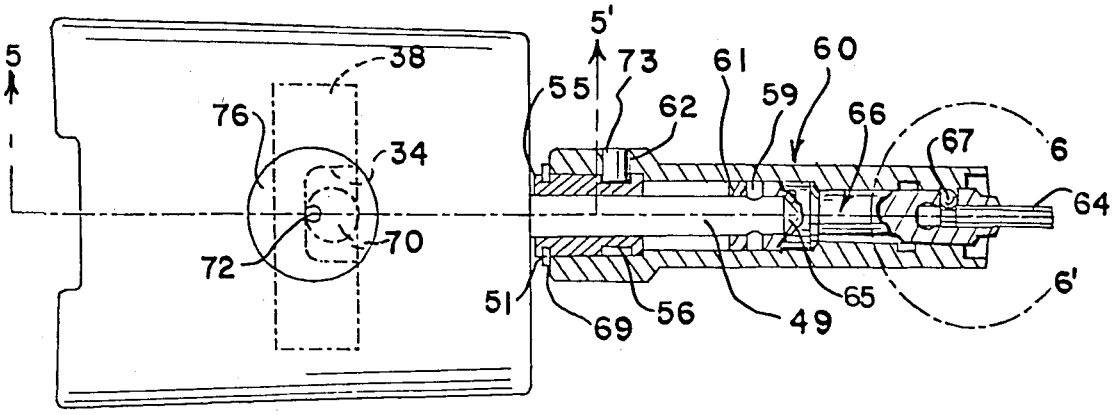
FIG. 4 is an elevational view, partially in cross section, of the assembled gear housing and socket and key members.
Figure 5:
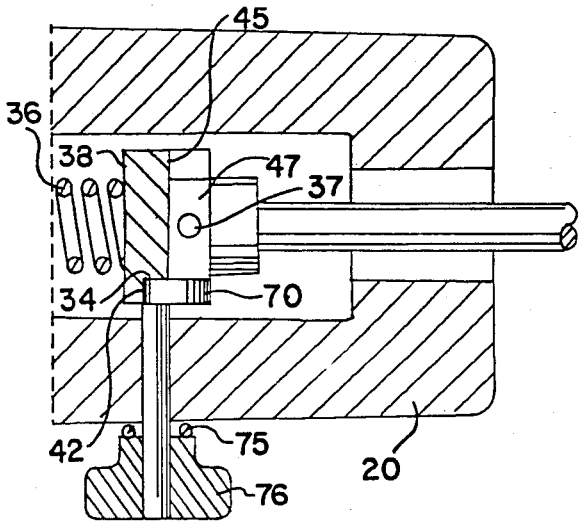
FIG. 5 is a view along line 5–5' of FIG. 4.

Referring now to FIG. 4, the wrenching tool, as modified in accordance with this invention, is shown in elevational view, with the forward portion of the wrenching tool in partial cross section. The release mechanism knob is also shown, with the cam release mechanism illustrated in phantom lines. The release mechanism consists of the knob 76, O-ring 75, release mechanism shaft 74, and the distally supported circular cam 70 which resides in the cam guide 34 that is milled into the slide block 38. the aforementioned release mechanism structure is shown by FIG. 5 in sectional view along line 5-5' of FIG. 4. As there illustrated, the sectional view extends through the cross slot 45 of the slide block 38 which receives the flatted end 47 of the key shaft 49. The slide block 38 and key shaft 49 have aligned bores to receive pin 37, thereby forming a key shaft subassembly. As previously mentioned, this key shaft subassembly provides for rotational restraint of the key shaft 49 while permitting sliding, axial movement thereof. The circular cam 70 bears against the forward face 42 of the cam guide 34 which is milled in slide block 38. The central key shaft subassembly is resiliently biased in a forward direction by compression spring 36.

Referring again to FIG. 4, the socket member 60 is received over the end of power output shaft 55, which has a first annular groove 56, and a second, smaller annular groove 51. The socket member has an aperture 62 which receives a pin 73 which seats in annular groove 56 to secure the assembly. A retaining ring 69 is seated in the annular groove 51. The outer end of key shaft 49 is received in a central bore 65 in the end of the key holder 66 and is secured thereto by pin 59 which extends through bore 61 in the key holder and an aligned bore 57 (see FIG. 2) in the key shaft 49.

The key member 64 is received in the end of the key holder and is restrained therein by a detent ball 67. This construction provides for the facile removal and replacement of the central key member 64, and is illustrated in detail by FIG. 6. The key member has a working end 78 and a tool insertion end 80. The shank 81 of the pin has a non-circular cross section to provide for its rotational restraint. Preferably, and in accordance with conventional construction, this shank has a hexgonal flatted surface and is received in central bore of the key holder which is broached with a mating hexagonal flatted internal surface. The tool end 80 of key is cylindrical and has a distal grove 82. The key holder 66 has a cross bore 84 which intersects its central bore, thereby providing a precise axial abutment or stop for the insert end of the key as well as facilitating the broaching of this central bore. The key holder 66 also has a detent member cavity, which can be a through bore 79 which receives the detent member, which is preferably a detent ball 67. The detent ball 67 can be restrained from complete dislodgement from the detent cavity by staking the ends of the cavity, as shown at 85.

Figure 6:
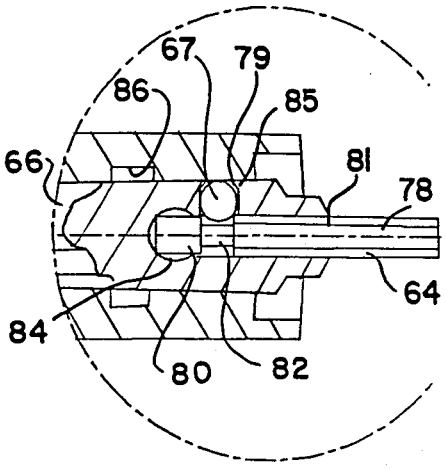
FIG. 6 is an enlarged view of the area defined by line 6-6' of FIG. 3.

The socket member is provided with a detent member recess, preferably in the form an annular grove 86 at a preselected axial distance. The assembly is illustrated in FIGS. 4 and 6 in a position where the key member 64 is axially restrained in the assembly by the detent ball 77 which seats in the distal grove 82 of the key member. This position corresponds to the release mechanism cam position shown in FIG. 4. In this position, the inner end of the key member 64 seats against the end of the keyway bore 61, a distance which is precisely controlled by the position of the second cross bore 84 in the key holder member 66, and the key holder and key members are positively interlocked. The end 80 of key 64 thereby provides the abutment stop to limit axial displacement of the key 64 in receiving bore 68 when the detent ball is aligned with its transverse groove 86. In this position, the key holder and key members will slide together without any lateral force being exerted on the ball 67, since the key is bottomed against the end wall of bore 84, causing the two to move together in the direction retracting the key holder subassembly in the drive assembly. The two members also will move together in the opposite direction, e.g., if the key member is pulled in an attempt to extract it, as spring 36 (shown in FIGS. 2, 5 & 8) will cause the key holder subassembly to move with the key 64.

Once the key is inserted to the position shown in FIG. 6, it can be extracted only by releasing the detent ball, a procedure which requires the holder to be moved to align the ball with the ball recess in the outer socket member and immobilized in this position.

Figure 7:
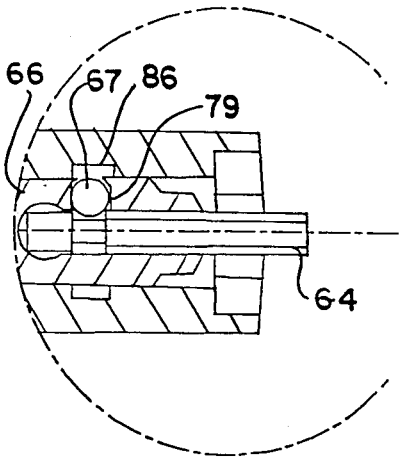
FIG. 7 illustrates the same components as FIG. 6, but with the key holder shifted to a release position.

Referring now to FIG. 7, the key holder 66 has been retracted to the predetermined and precise axial orientation with the detent cavity 79 of the key holder 66 precisely aligned with the annular grove 86 of the outer, socket member 60. In this position, any retraction force applied to the key member 64 will dislodge the detent ball 67 into the annular groove 86, freeing the key member 64 for removal and replacement, once the ball has moved outwardly sufficiently to pass the received end 80 of reduced thickness, the key can be extracted from the assembly.

Figure 8:
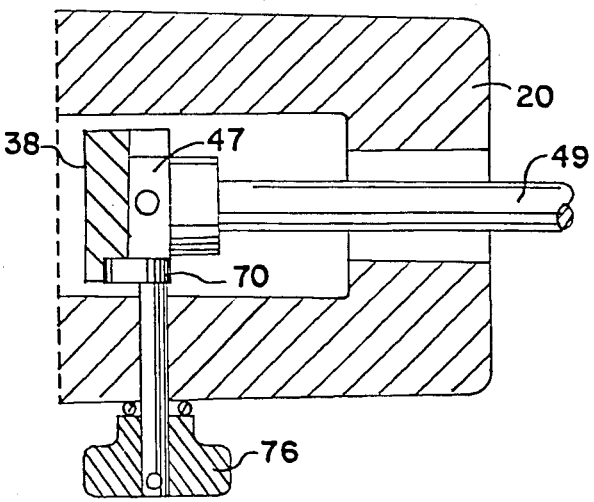
FIG. 8 illustrates the cam position for release of the key.

The cam position for the cam 70 of the release mechanism is illustrated for the release position in FIG. 8. As there illustrated, the release knob 76 has been rotated 180 degrees, reversing cam 70 in the assembly and retracting the key member subassembly the necessary, precise axial displacement to align detent ball cavity 79 with the annular groove 86.

The invention as thus described is a simple, yet elegant modification of existing tools to adapt them for use with the key member and detenting assembly which is described and claimed in my aforementioned parent application. No significant retooling is required for adapting the pre-existing rotational drive tools to use of the key. Instead, the same gear drive housing and gear drive mechanism is utilized with only a simple modification which requires the steps of tapping the sidewall of the gear housing to receive the release mechanism shaft, assembly of the cam, shaft and control knob of the release mechanism, milling of the cam guide in the slide block, tapping receiving apertures and inserting a roll pin to interconnect the central key member shaft and the slide block in a key member subassembly; and providing the socket member, key holder and key which are illustrated in FIGS. 4, 6 and 7.

The improvements in the use and operation of the drive tool are very substantial. The key members can be readily replaced simply by rotating the release mechanism knob 180 degrees and extracting the key member, all without the necessity for any disassembly of the socket member or any components of the tool. Broken and badly worn key members can thus be quickly and efficiently replaced or, when necessary, the key member can be removed and the drive tool used to apply fasteners in interference fit applications where immobilizing the bolt of the fastener is not necessary. The greater efficiency in operation of the drive tool significantly reduces assembly costs of products such as aircraft which require thousands of fasteners and interference and noninterference applications.

The invention has been described with reference to the illustrated and presently preferred embodiment. It is not intended that this disclosure of the presently preferred embodiment be unduly restricting. Instead, it is intended that the invention be defined by the means, and their obvious equivalents, set forth in the following claims.

What is claimed is:

1. A rotational wrenching tool having a housing supporting an outer, rotationally driven member with a central bore having an interior wall recess and a key holder subassembly axially-slidably received in said central bore of said driven member, and including:

(a) a sliding block member axially-movably mounted in said housing;

(b) a key holder member fixedly coupled to said sliding block member and having a longitudinal receiving bore in one end with a cross bore intersecting said receiving bore, and a detente member seated in said cross bore;

(c) a cam shaft received through a sidewall of said housing;

(d) a cam carried on the end of said cam shaft within said housing;

(e) a cam guide on said sliding block member and operatively receiving said cam, whereby movement of said cam shaft to a predetermined angular position precisely locates said key holder subassembly with said cross bore aligned with said interior recess of said outer driven member.

2. The wrenching tool of claim 1 wherein said outer driven member distally supports a socket member.

3. The wrenching tool of claim 2 wherein said interior wall recess is an annular groove on the inside wall of said central bore of said outer driven member.

4. The wrenching tool of claim 1 wherein said detent member is a ball member received in said cross bore and having a diameter slightly greater than the length of said cross bore in which it is received.

5. The wrenching tool of claim 1 in combination with a key member removably mounted in said receiving bore with an annular groove about its end mounted in said receiving bore, and with said detent member seated in said annular groove.

6. The wrenching tool of claim 5 including stop means on said key holder member and cooperating abutment means on said key to limit the axial movement of said key into said receiving bore when its outer annular groove is opposite said ball, whereby said ball can be displaced inwardly a sufficient distance to permit said key holder member free sliding engagement within said outer member.

7. The wrenching tool combination of claim 6 wherein said key member has at least one longitudinal flat and said receiving bore has a mating cross section, thereby rotationally indexing said key and holder members.

8. The wrenching tool combination of claim 4 wherein said outer driven member supports a distal socket and said holder and receiving bore are coaxial therewith.

9. The combination of interlocking members of claim 8 wherein said outer and holder members are a wrenching tool subassembly and said outer member bears gear teeth for engagement by a driving member.

10. In a drive gear assembly for a rotational wrenching tool having a gear drive housing with an output shaft and a socket member removably mounted on said output shaft, said socket member having a central bore with an interior wall recess and a key holder axially-slidably received in said central bore of said driven member, a sliding block member axially-moveably mounted in said gear drive housing, said key holder having a key holder shaft slidably received in said output shaft and indexed to said sliding block member and thereby rotationally restrained, with a longitudinal receiving bore in its outer end, and a cross bore intersecting said receiving bore, and a detent member seated in said cross bore; the improvement comprising:

(a) first attachment means securing the inner end of said key holder shaft to said sliding block member;

(b) second attachment means securing the outer end of said key holder shaft to said key holder, thereby forming a key holder subassembly;

(c) a cam shaft received through a sidewall of said housing;

(d) a cam carried on the end of said cam shaft within said housing;

(e) a cam guide on said sliding block member and operatively receiving said cam, whereby movement of said cam shaft to a predetermined angular position precisely locates said key holder subassembly with said cross bore aligned with said interior recess of said outer driven member.

11. The improvement of claim 10 wherein said interior wall recess is an annular groove on the inside wall of said central bore of said socket member.

12. The improvement of claim 10 wherein said detent member is a ball member received in said cross bore and having a diameter slightly greater than the length of said cross bore in which it is received.

13. The improvement of claim 10 in combination with a key member removably mounted in said receiving bore with an annular groove about its end mounted in said receiving bore, and with said detent member seated in said annular groove.

14. The improvement of claim 13 including stop means on said key holder shaft and cooperating abutment means on said key to limit the axial movement of said key into said receiving bore when its outer annular groove is opposite said ball, whereby said ball can be displaced inwardly a sufficient distance to permit said key holder shaft free sliding engagement within said output shaft.

15. The improvement of claim 14 wherein said stop means comprises a second cross bore in said key holder shaft intersecting said receiving bore at a predetermined distance from said cross bore which receives said detent member.

16. The improvement of claim 14 wherein said key member has at least one longitudinal flat and said receiving bore has a mating cross section, thereby rotationally indexing said key and key holder members.

* * * * *